United States Patent [19]

Goller et al.

[11] Patent Number: 4,858,446

[45] Date of Patent: Aug. 22, 1989

[54] THREAD-GUIDE ARM

[75] Inventors: Ernst Goller; Dieter Wurst, both of Reutlingen; Guenther Kazmaier, St. Johann-Ohnastetten; Jochen Frei, Moessingen, all of Fed. Rep. of Germany

[73] Assignee: H. Stoll GmbH & Co., Fed. Rep. of Germany

[21] Appl. No.: 236,203

[22] Filed: Aug. 25, 1988

[30] Foreign Application Priority Data

Sep. 30, 1987 [DE] Fed. Rep. of Germany ..... 3732879

[51] Int. Cl.[4] ..... D04B 15/52

[52] U.S. Cl. ..... 77/126 R; 66/126 A

[58] Field of Search ..... 66/126 R, 126 A, 125, 66/127; 242/157

[56] References Cited

U.S. PATENT DOCUMENTS 1,893,808 1/1933 Spector ..... 66/126 A 2,277,797 3/1942 Strzalkowski ..... 66/126 R

FOREIGN PATENT DOCUMENTS 685507 12/1939 Fed. Rep. of Germany ... 60/126 A

*Primary Examiner*—Ronald Feldbaum

*Attorney, Agent, or Firm*—Larson and Taylor

[57] ABSTRACT

In the thread-guide arm (11), the thread-guide members (15 to 17) arranged above the thread-guide pulley (12) are formed in a thread-guide star (20) which is arranged immediately in front of a thread-restraining plate (21) and is preferably made in one piece with the latter. The thread-restraining plate (21) has a smooth outer edge having no acute angles, and the exposed edges of the thread-guide star (20) are rounded or bevelled, so that no threads can catch on the thread-guide star and the thread-restraining plate.

8 Claims, 3 Drawing Sheets

THREAD-GUIDE ARM

The invention relates to a thread-guide arm with thread-guide members arranged on the arm above a thread-guide pulley, particularly to a thread guide arm for use in a flat-bed knitting machine.

It is known to feed thread to a thread-guide pulley on thread-guide arms via a thread-guide eyelet fastened to the thread-guide arm as a thread-deflecting member. Since a thread can be fed to the thread guide from either the left or right a thread-deflecting eyelet is fastened on each side of the thread-guide arm to a holding arm projecting beyond the thread-guide arm. A further thread-guide eyelet is often also fastened to the thread-guide arm, the eyelet axis of which is aligned with the direction of movement of the thread guide and through which a thread intended for another thread guide can be led for the purposes of support. The disadvantage of these thread-guide members is that fluctuations of tension in the guided threads can cause thread sag to occur and as a result, a thread can catch on the outside of the thread-guide eyelet or on its supporting arm, thus resulting in a thread break.

The object on which the invention is based is to provide the thread-guide members arranged on the thread-guide arm in such a way that no thread can catch on them.

According to the invention, the object is achieved in a thread-guide arm of the type mentioned above by the arrangement of the thread-guide members immediately in front of a thread-restraining plate such that no gap is formed therebetween, the outer edge of the plate being free of acute angles.

The thread-restraining plate prevents the possibility that a thread loop will wrap itself round a thread guide member, and the plate is itself designed so that a thread or a thread loop also cannot catch on it, but will slide off its edge.

Advantageously, the thread-guide members can consist of eyelets or bores inserted into or formed in lugs or webs which are attached to the thread-restraining plate and the exposed edges of which are rounded or flattened. In a preferred embodiment, the webs provided with thread-guide bores or thread-guide eyelets are made in one piece with the thread-restraining plate. Appropriately, the thread-restraining plate can be produced, together with the thread-guide members as a lost wax casting and is provided with an abrasion-resistant coating.

The thread-restraining plate can have a substantially circular outer edge, but can also be composed of segments of an arc of a circle and of straight edge segments, so that no acute angles, on which a thread or a thread loop could catch, occur on its edge. Advantageously, the thread-restraining plate can have a recess suitable for receiving the arm on its rear side so that its rear side forms with the rear side of the thread-guide arm a plane surface and projections or steps, on which threads could catch, are avoided.

Exemplary embodiments of a thread-guide arm designed according to the invention are explained in detail below with reference to the accompanying drawings in which.

Figure 1:
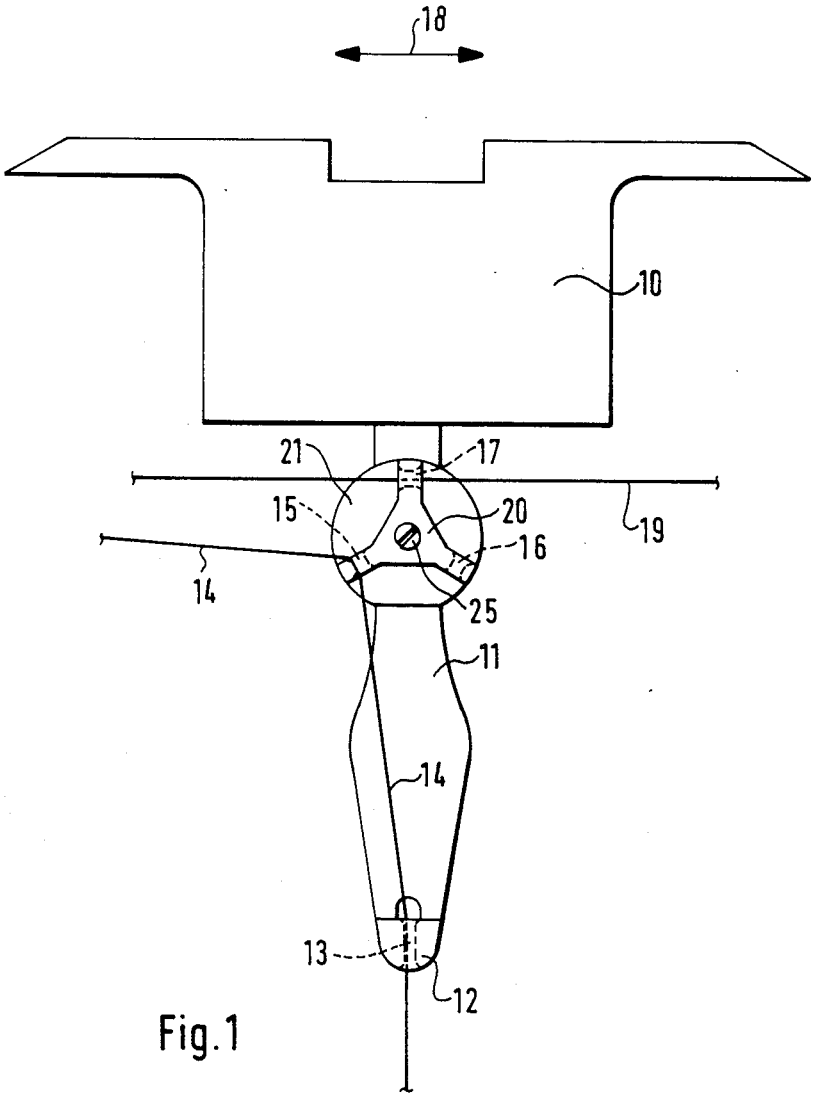
FIG. 1 shows a diagrammatic plan view of a thread guide with a thread-guide arm designed according to one embodiment of the invention.
Figure 2:
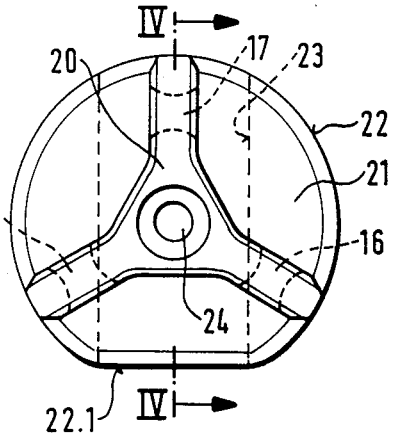
FIG. 2 shows, in a plan view, an individual representation of the thread-restraining plate equipped with the thread-guide members as shown in FIG. 1.
Figure 3:
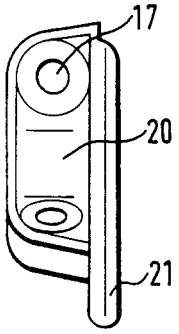
FIG. 3 shows a side view of the thread-restraining plate as shown in FIG. 1.
Figure 4:
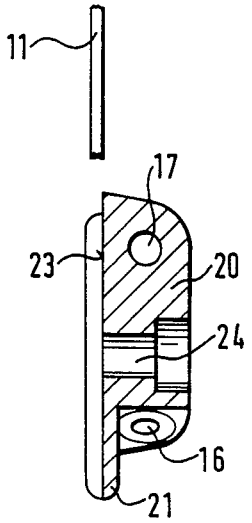
FIG. 4 shows a section through the thread-restraining plate along the line IV—IV of FIG. 2.
Figure 5:
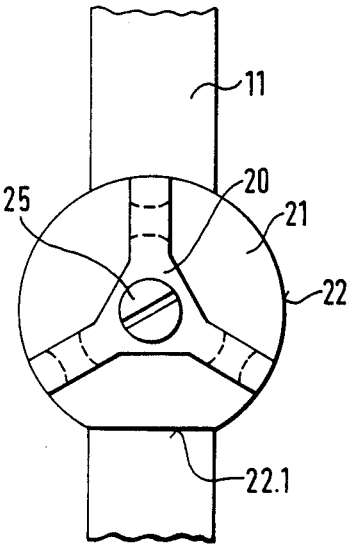
FIGS. 5, 6, and 7, show thread-restraining plates with an outer edge of differing form.

FIG. 1 shows a diagrammatic plan view of a thread guide 10 for a flat knitting machine, the thread guide being mounted on a thread-guide rail (not shown) so as to be adjustable parallel to the needle beds. The thread guide 10 carries a flat and blade-like thread-guide arm 11 which is mounted rigidly or pivotably and at the end of which is arranged a likewise flat pulley 12 with a passage bore 13 for a thread 14 to be fed to the needles of the flat knitting machine. The thread 14 is delivered to the pulley 12 via a thread-guide eyelet 15 which, together with two additional thread-guide eyelets 16 and 17, is arranged on the thread-guide arm 11. The other thread-guide eyelet 16 serves as a thread-deflecting eyelet for a thread which can be fed from the other side of the thread guide. The thread-guide eyelet 17 serves as a supporting eyelet for a thread 19 guided to an adjacent thread guide (not shown) in the thread-guide adjustment direction 18. The three thread-guide eyelets 15, 16 and 17 are formed as bores in webs of a thread-guide star 20 which is arranged in front of a-thread-restraining plate 21 and is produced in one piece with the latter from lost-wax metal casting and which is provided with an abrasion-resistant coating FIGS. 2 to 5 show the thread-restraining plate 21 with its thread-guide star 20 in an individual representation enlarged in comparison with FIG. 1. The thread-restraining plate 21 has the form of a flat disc with a substantially circular edge 22. Only at its lower point has it a straight edge segment 22.1 extending over the width of the thread-guide arm 11. The thread-restraining plate 21, on its rear side, is equipped with a wide groove 23, the width of which corresponds exactly to the width of the thread-guide arm 11 at the fastening point of the thread-restraining plate 21 and the depth of which, according to the sectional representation of FIG. 4, is maintained so that the flat thread-guide arm can penetrate completely into the groove 23. The thread-guide star 21 arranged on the thread-restraining plate 21 and with its three star webs containing the three thread-guide bores 15,16 and 17 has rounded edges to prevent threads from catching. Formed in the centre of the thread-guide star 20 is a stepped passage bore 24 for the countersunk arrangement of a fastening screw 25 evident from FIG. 1.

Figure 6:
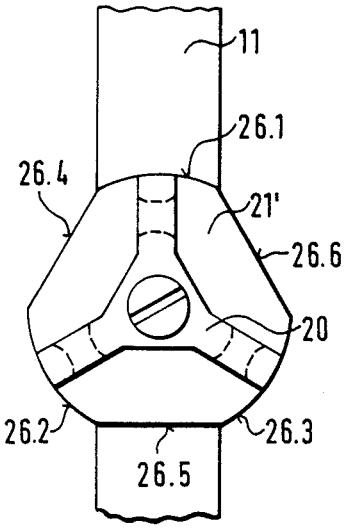
Figure 7:
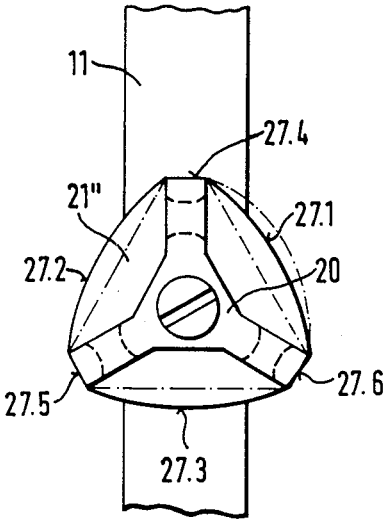

FIG. 5 again shows the thread-restraining plate 21 according to FIGS. 1 to 4 with its substantially circular outer edge 22. FIG. 6 shows a thread-restraining plate 21', the outer edge of which is composed of alternating segments 26.1, 26.2, 26.3 of an arc of a circle and straight edge segments 26.4, 26.5 and 26.6. Finally, FIG. 7 shows a thread-restraining plate 21'', in which the edge predominantly consists of three arc segments 27.1, 27.2 and 27.3 which are connected to one another at the web ends of the thread-guide star by means of short straight segments 27.4, 27.5 and 27.6. In all three cases, the thread-guide star 21 is designed in the same way as a three-armed star. As a result of the straight edge segments of the thread-restraining plates 21' and 21', a thread can be introduced into the thread-guide eyelets 15 to 17 more easily.

We claim:

1. A thread-guide arm having thread-guide members arranged on said arm above a thread-guide pulley, said thread-guide members being formed as webs attached to and arranged immediately in front of a thread-restraining plate and having bores defined in said webs, the outer edges of said plate being free of acute angles.

2. A thread-guide arm as claimed in claim 1, characterized in that the webs with the thread-guide bores are made in one piece with the thread restraining plate.

3. A thread-guide arm as claimed in claim 1 characterized in that the webs are arranged and connected to one another in a star-shaped manner and a passage bore is defined in the centre of said star for a screw to fasten the arrangement to the thread-guide arm.

4. A thread-guide arm as claimed in claim 1 characterized in that the thread-restraining plate has recess defined on its rear side suitable for receiving an arm.

5. A thread-guide arm as claimed in claim 1 characterized in that the thread-restraining plate has a substantially circular outer edge.

6. A thread-guide arm as claimed in claim 1 characterized in that the outer edge of the thread-restraining plate consists of segments of an arc of a circle alternately with straight edge segments.

7. A thread-guide arm as claimed in claim 1 characterized in that the thread restraining plate and the thread-guide members are formed together as a lost-wax casting and have an abrasion-resistant coating.

8. A thread-guide arm as claimed in claim 1 characterized in that the thread-guide bores each have a cross-section which flares at the ends thereof.

* * * * *